US005946824A

United States Patent [19]

Tighe et al.

[11] Patent Number: 5,946,824

[45] **Date of Patent: *Sep. 7, 1999**

[54] SOLE SUPPORT STRUCTURE FOR AN ATHLETIC SHOE

[75] Inventors: Robert P. Tighe, Easton, Pa.; Thomas A. J. Yannitte, Bound Brook, N.J.

[73] Assignee: Orion Sports & Leisure, Inc., Belle Mead, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/914,407

[22] Filed: Aug. 19, 1997

[51] Int. Cl.[6] ..... A43B 13/18; A43B 13/00

[52] U.S. Cl. ..... 36/28; 36/3 B; 36/25 R

[58] Field of Search ..... 36/3 B, 28, 25 R, 36/29, 31, 30 R, 32 R, 141

[56] References Cited

U.S. PATENT DOCUMENTS

| | | | |
|---|---|---|---|
| 2,150,057 | 3/1939 | Fisch | 36/3 B |
| 2,527,414 | 10/1950 | Hallgren | 36/32 R |
| 2,580,840 | 1/1952 | Rogndal | 36/32 R |
| 2,985,971 | 5/1961 | Murawski | 36/3 B |
| 4,020,569 | 5/1977 | Fukuoka | 36/30 R |
| 4,075,772 | 2/1978 | Sicurella | 36/141 |
| 4,133,118 | 1/1979 | Khalsa et al. | 36/32 R |
| 4,663,865 | 5/1987 | Telecemian | 36/30 R |
| 5,367,788 | 11/1994 | Chen | 36/3 B |

*Primary Examiner*—M. D. Patterson

*Attorney, Agent, or Firm*—Pennie & Edmonds LLP

[57] ABSTRACT

A shoe construction for supporting an inner sole providing a plurality of spaced-apart pedestal sole support areas. Each pedestal support area is partially stabilized by adjacent supporting walls which walls have reduced height areas close to the support area. Partial stability provides adequate support for the active shoe wearer while at the same time permitting the pedestal support areas to move within a limited area or orbit.

6 Claims, 3 Drawing Sheets

SOLE SUPPORT STRUCTURE FOR AN ATHLETIC SHOE

BACKGROUND OF THE INVENTION

Numerous sole support structures have been suggested including a pattern of vertical support walls (U.S. Pat. No. 4,449,307) and configured web units (U.S. Pat. No. 5,337, 492).

SUMMARY OF THE INVENTION

Broadly, the present invention comprises a shoe construction in which the inner sole is supported by a matrix of pedestals including a plurality of spaced-apart pedestal inner sole support areas. The pedestals are normally distributed throughout the underside of the inner sole configuration to provide sole support. Each pedestal area is supported and braced by support walls which have reduced height portions adjacent each pedestal to permit each pedestal area to move in numerous directions during shoe use including in a circular orbit about the pedestal's vertical axis.

DESCRIPTION OF THE PREFERRED EMBODIMENTS

Figure 1:
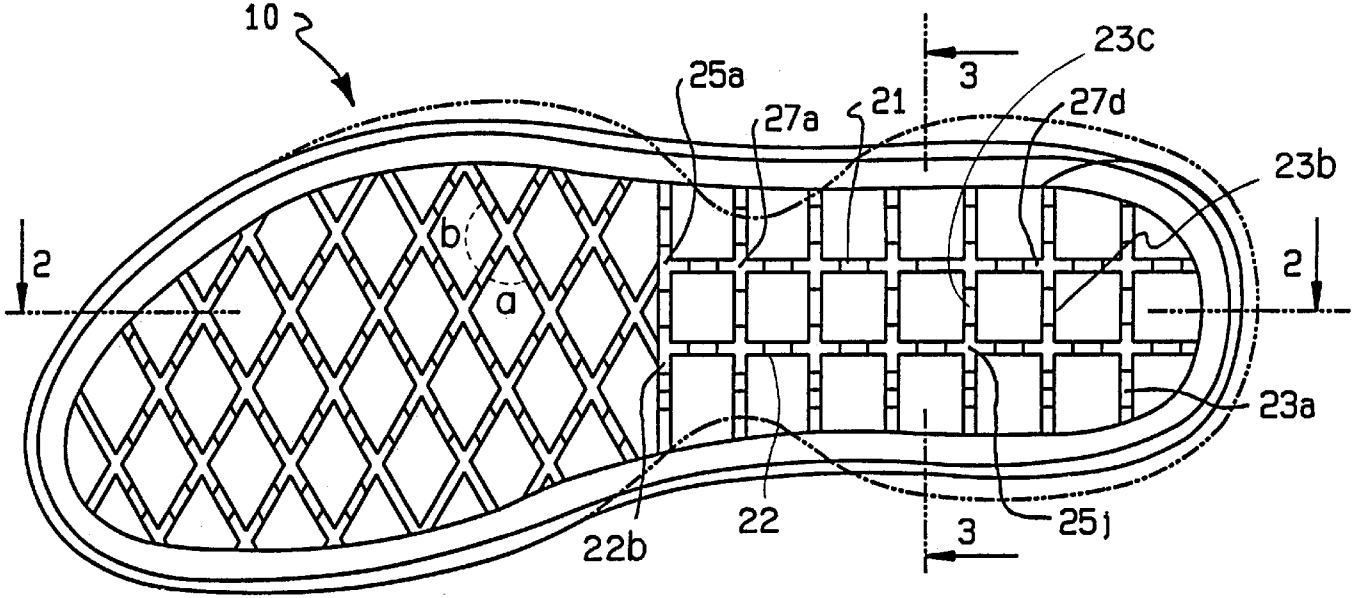
FIG. 1 is a plan view of the shoe construction of the present invention.

In FIGS. 1–4, shoe 10 includes upper shoe portion 11 and outer sole 13 including arch 13*a*. Positioned on outer sole 13 is inner sole support web matrix 16 including heel section 17 and forward section 19. Web matrix 16 is made of rubber or other resilient material.

Figure 2:
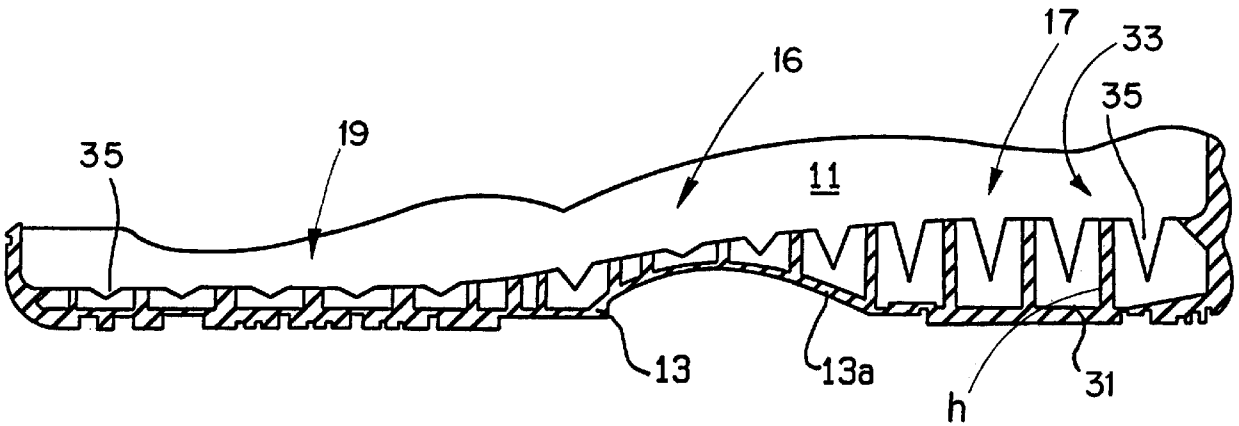
FIG. 2 is a sectional view along line 2—2 of FIG. 1.
Figure 3:
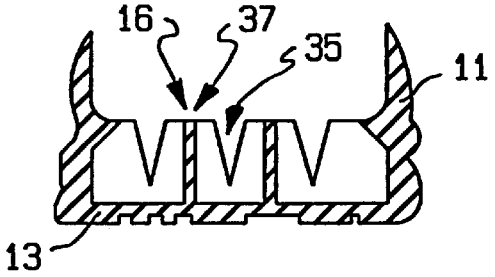
FIG. 3 is a sectional view along line 3—3 of FIG. 1.
Figure 4:
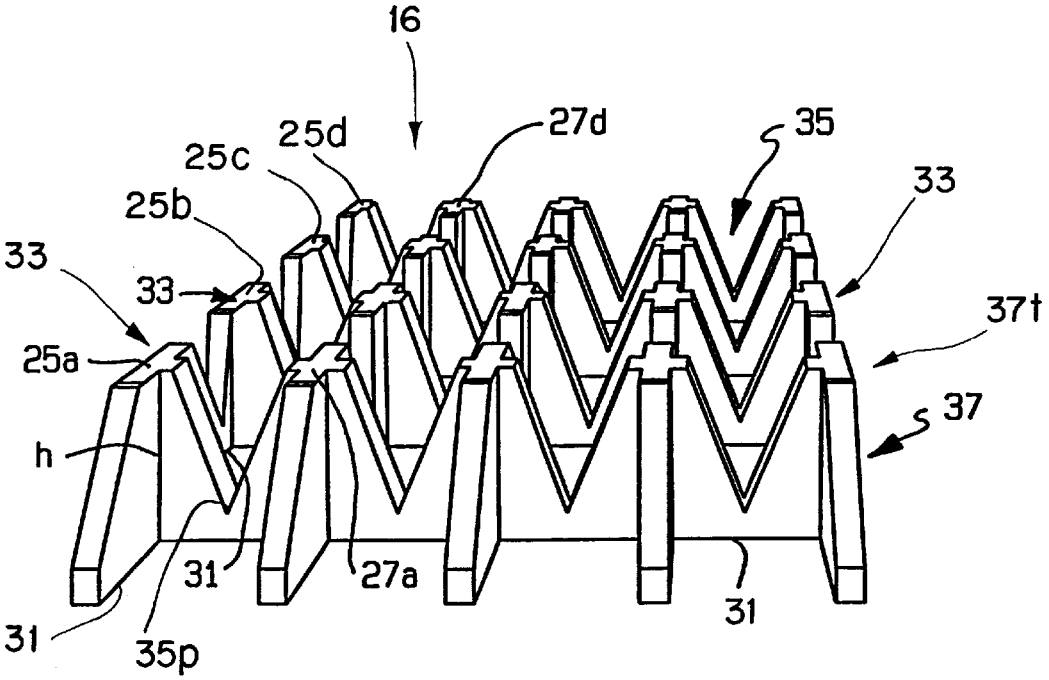
FIG. 4 is a perspective view of an alternative sole support matrix including four longitudinal rows of pedestals.
Figure 5:
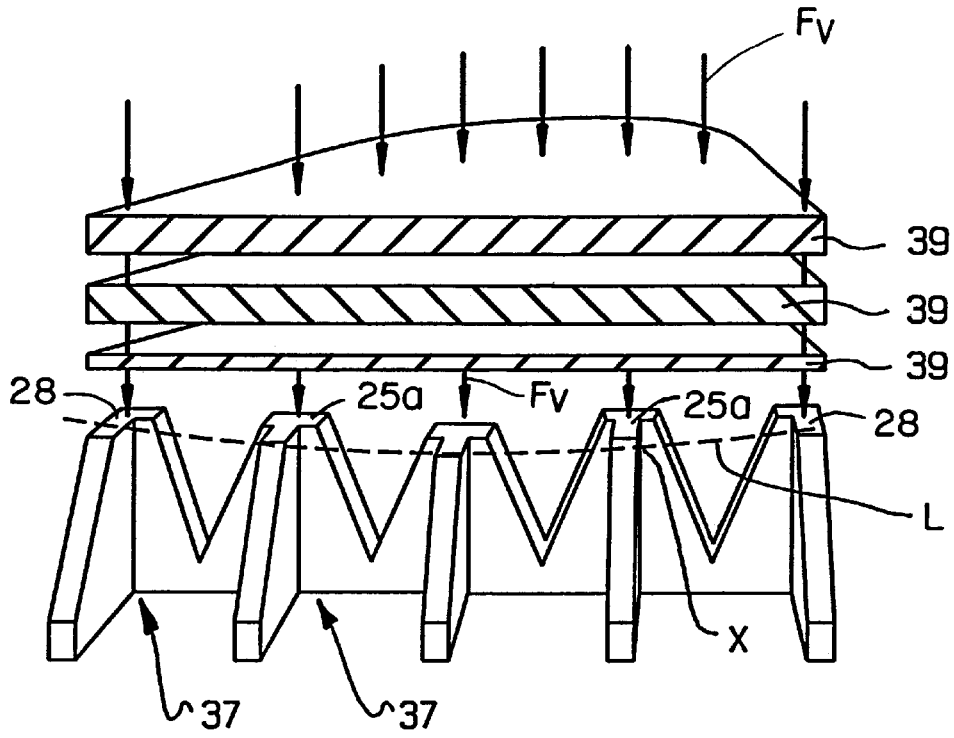
FIG. 5 is a perspective and exploded view of a row of the support matrix and inner sole layers.

Support matrix heel section 17 includes longitudinal upright support walls 21, 22 and cross support walls 23*a*–*g*. Walls 21, 22 and 23*a*–*g* have lower surfaces 31 and top sole-support surfaces 33 which define their heights (h) (FIGS. 2 and 4). The height of walls 21, 22 and 23*a*–*g* are reduced at selected locations by openings 35 which are preferably V-shaped with lowest points 35*p* (FIG. 2). Other opening shapes may be used. Walls 21, 22 and 23*a*–*g* intersect to form surfaces 33 which are outer T-shaped pedestal areas 25*a*–*d* and cross shaped pedestal areas 27*a*–*l*. The cross pedestal areas and T-shaped areas provide support of inner soles 39*a*–*c* (FIG. 5). Support walls 21, 22 and 23*a*–*g* have height-reducing openings 35 which create support pyramid-shaped pedestals 37 with each pedestal 37 having a pedestal shoe support area 25*a*–*d* or 27*a*–*l*. The heel section of the shoe 10 (FIG. 1) has two longitudinal walls 21, 22 while the alternative matrix has four (4) longitudinal walls (FIG. 4). Any number or size of longitudinal and cross support walls may be used in the heel or toe section of the shoe.

Support matrix forward section 19 is constructed similarly to heel section 17 except support walls intersect at non-right (oblique) angles a and b. Support walls have less height in the toe section and openings 35 are shallower.

Figure 4A:
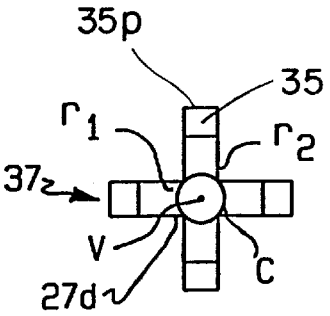
FIG. 4*a* is a partial plan view of the matrix with an inner pedestal area of FIG. 4.
Figure 4B:
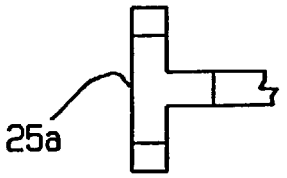
FIG. 4*b* is a partial plan view of the matrix with an outer pedestal area of FIG. 4.
Figure 4C:
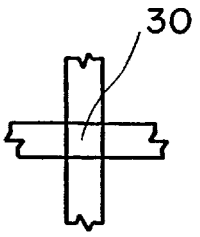
FIG. 4*c* is a top view of an alternative pedestal area which is rectangular in shape.

In FIG. 4*a* cross pedestal support seat area 27*d* consists of two intersecting rectangles $r_1$ and $r_2$. Vertical axis (V) passed through pedestal 37. Pedestal 37 includes that portion of the walls adjacent the sole support area down to opening lowest points 35*p*. Also shown in FIG. 4*a* is circle C illustrating an area of movement that the pedestal top 37*t* and the vertical axis (V) passing therethrough and terminating in the support area plane may move through in shoe use as pedestal 37 torques, bends, twists, moves and otherwise deforms. T-shaped pedestal area 25*a* (FIG. 4*b*) and rectangular pedestal area 30 (FIG. 4*c*) are additional pedestal area shapes. Area 30's shape is created by having openings 35 positioned nearer the center (vertical axis (V)) of pedestal 37.

Figure 6:
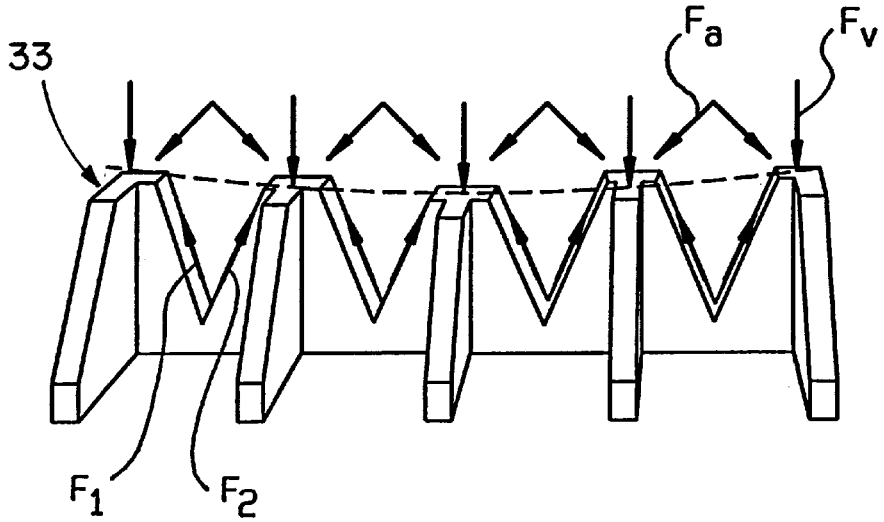
FIG. 6 is a row of the support matrix deformed by the forces exerted on the shoe soles and support matrix when in use.

Turning now to FIGS. 5 and 6, a row of pedestals 37 is shown with deformation of the outer pedestal 37 less than the inner pedestal 37 with the variation in pedestal compressed height creating a curvature line (X) passing through or adjacent L-shaped pedestal sole support areas 28 and T-shaped sole pedestal support areas 25*a*. Forces $F_v$ are the forces downward and $F_a$ are the forces downward with horizontal components. Forces $F_1$ and $F_2$ are the forces exerted by pedestals 37 and openings 35 to withstand the downward forces.

In the operation of shoe 10 of the present invention, the wearer of the shoe places weight on the shoe by standing, walking or otherwise moving , which weight and forces are created by and are associated with such loading, movement, acceleration and deceleration of such wearer's illustrated by forces $F_v$, $F_a$, $F_1$, $F_2$, etc. (FIGS. 5 and 6). Support matrix 16 including pedestals 37 and their pedestal support seat areas 27*a*–*l* and areas 25*a*–*d* which areas support one or more shoe soles 39*a*–*c*. Lateral forces resulting from walking, running and stopping cause pedestal areas 25 and 27 to bend, compress and otherwise distort causing one or more pedestal vertical axes (V) to move in an orbit approximated by circle (C) (FIG. 4*a*). Axis (V) extends through pedestal 37 from lower surface 31 to upper surface 33. Sole 39*a* is preferably attached to sole support areas 33 including support areas 25*a*–*d*, 27*a*–*l*, *30* or other shaped sole support areas by adhesive or otherwise. Alternatively, sole 39*a* may rest on support areas 33 without attachment. Soles 39*a*–*c* may be attached to one another or may not be so attached. Attachment of sole 39*a* to areas 33 and attachment of one or more soles adds relative stability to pedestals 37.

The matrix construction of the present invention provides partial stability with the pedestals 37 permitting some movement of the areas 33 side-by-side, back and forth or a limited orbital area such as the circle (C) of FIG. 4*a*. By varying the number of supporting walls and their height adjacent the support areas, the relative stability of each pedestal is controlled.

We claim:

1. A shoe construction comprising a) a base sole;

b) an upper shoe portion;

c) a support matrix on the base sole;

d) an inner sole supported by the matrix;

e) the support matrix in turn comprising i) a plurality of pedestal support means created by at least two (2) parallel walls having first widths intersecting with at least two (2) other parallel walls having second widths forming at least four (4) intersection support areas for supporting the sole, a) a V-shaped opening in each wall between such intersection support areas, such V-shaped opening providing a wall opening which extends more than half the distance between such intersection support areas, and b) each intersection area shaped as a cross with one portion of the cross having the first wall width and the other portion having the second wall width.

2. The shoe construction of claim 1 in which pedestal support areas are attached to the inner sole.

3. The shoe construction of claim 1 in which the pedestal support means move in an orbit resulting from walking, running and stopping.

4. A shoe construction comprising a) a base sole;

b) an upper shoe portion;

c) a support matrix on the base sole;

d) an inner sole supported by the matrix;

e) the support matrix in turn comprising i) a first set of spaced apart rows of support walls having bottom surfaces adjacent the base sole and having top wall surfaces, the difference between the bottom and top surfaces determining the wall height;

ii) a second set of spaced apart rows of support walls with the first and second sets of walls intersecting to form a plurality of support pedestal areas for supporting the inner sole; and iii) a plurality of pedestal support means created by said first set of walls having first widths intersecting with said second set of walls having second widths forming at least four (4) intersection support areas for supporting the sole;

a) a V-shaped opening in each wall between such intersection support areas, such V-shaped opening providing a wall opening which extends more than half the distance between such intersection support areas, and b) each intersection area shaped as a cross with one portion of the cross having the first wall width and the other portion having the second wall width.

5. The shoe construction of claim 4 in which the inner sole is attached to the pedestal support means.

6. The shoe construction of claim 4 in which the pedestal support means move in an orbit resulting from walking, running and stopping.

* * * * *